US005449422A

United States Patent [19]

Pflanz et al.

[11] Patent Number: 5,449,422

[45] Date of Patent: Sep. 12, 1995

[54] METHOD AND DEVICE FOR THE HEAT TREATMENT OF HEAT TREATABLE MATERIAL IN AN INDUSTRIAL FURNACE

[75] Inventors: Rudolf Pflanz, Singen; Bernd Onderka, Korschenbroich; Franz Engelberg, Constance; Richard Breisinger, Reichenau, all of Germany

[73] Assignee: Klockner-Humboldt-Deutz AG, Cologne, Germany

[21] Appl. No.: 168,947

[22] Filed: Dec. 17, 1993

[30] Foreign Application Priority Data

Dec. 19, 1992 [DE] Germany ..... 42 43 127.1

[51] Int. Cl.[6] ..... C22F 1/04; F27B 17/00

[52] U.S. Cl. ..... 148/601; 266/252

[58] Field of Search ..... 148/601, 661, 698, 703; 266/102, 103, 111, 251, 252

[56] References Cited

U.S. PATENT DOCUMENTS 2,169,314 8/1939 Wilson ..... 148/601
2,613,070 10/1952 Verwohlt ..... 148/601
4,736,529 4/1988 Kramer ..... 266/251

*Primary Examiner*—Scott Kastler
*Attorney, Agent, or Firm*—Charles L. Schwab; Hardaway Law Firm

[57] ABSTRACT

In the heat treatment of heat treatable material in an industrial furnace, in particular for the annealing of annealable material such as, for example, aluminum strip wound into a coil (1), by means of blowing of the annealable material with hot gas jets (8) issuing from nozzles (7), in order to insure a very good and uniform heat transfer from the hot gas stream to the material and a completely uniform temperature distribution in the coil (1), and also the rapid heating thereof, without any need to fear locally partial overtemperatures in the coil, it is proposed in accordance with the invention to move the annealable material such as, for example, the coil (1), and the hot gas jets (8) relative to one another, for example by means of the fact that the coil (1) and/or the hot gas nozzles (7) are rotated about the coil axis, so that the blowing impingement points of the hot gas jets (8) move on the blown surface of the annealable material and all desired portions there can be swept in controlled fashion.

8 Claims, 7 Drawing Sheets

FIG.1
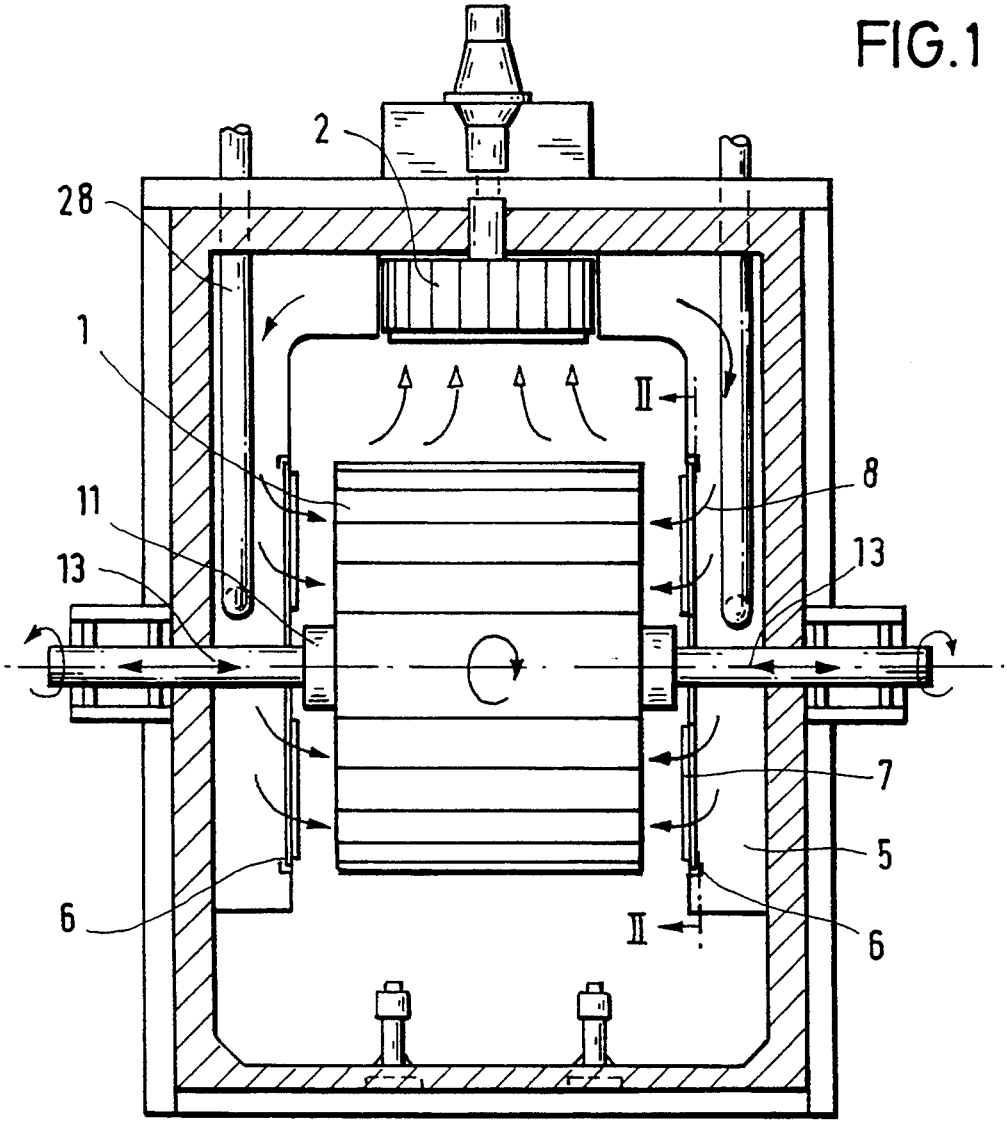
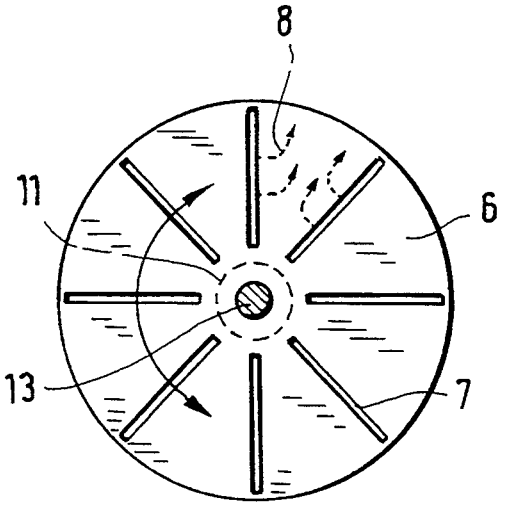
FIG. 2

FIG.5
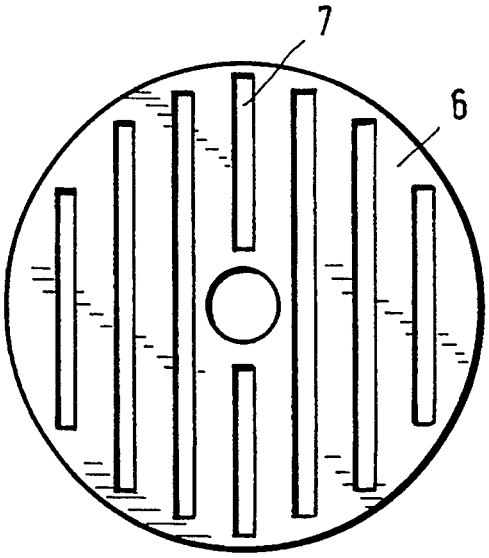
FIG.6
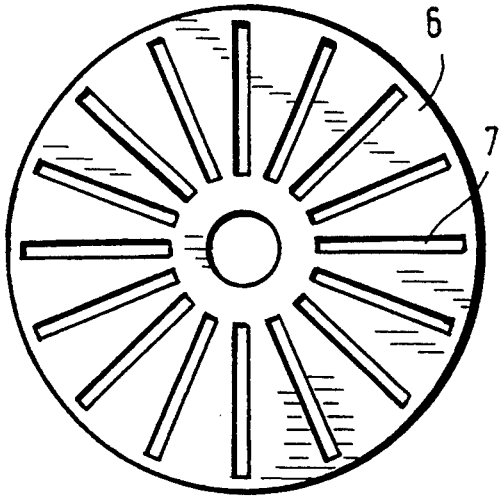
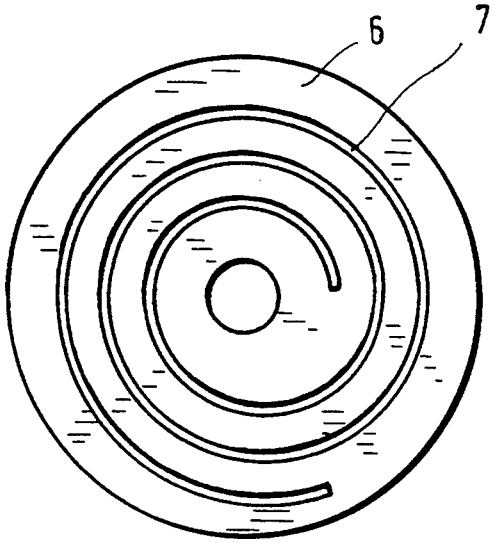
FIG.7
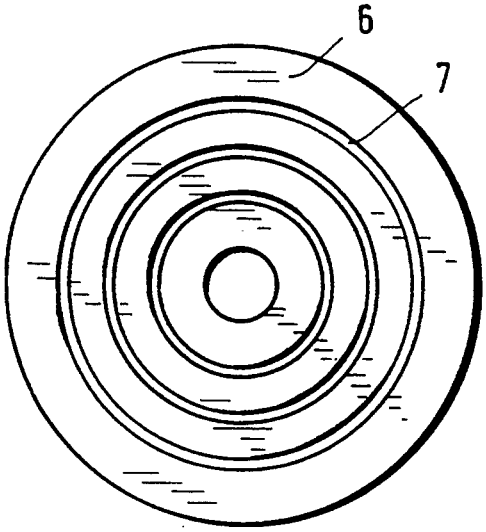
FIG.8

FIG.14
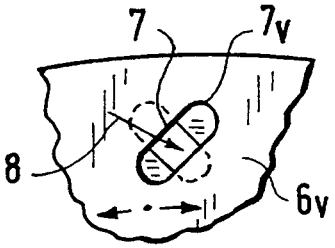
FIG.15
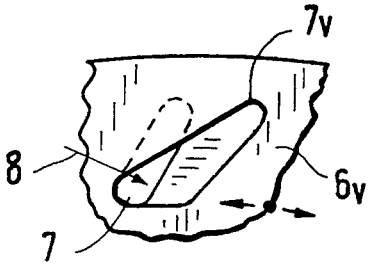
FIG.16
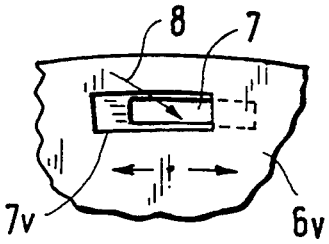
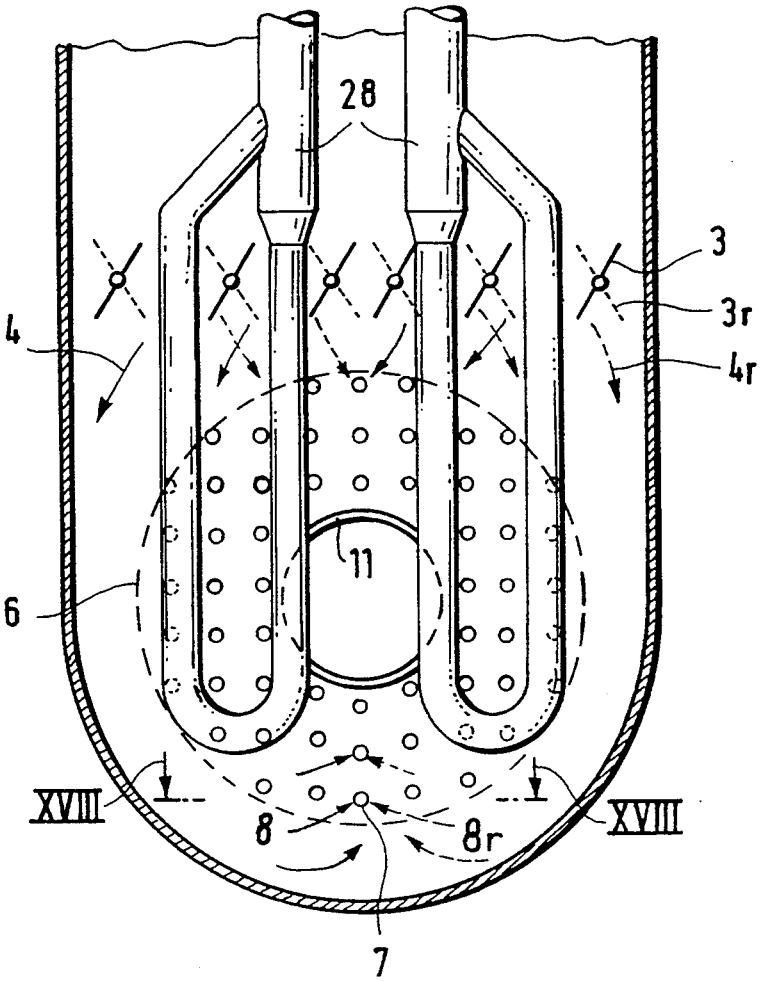
FIG.17

METHOD AND DEVICE FOR THE HEAT TREATMENT OF HEAT TREATABLE MATERIAL IN AN INDUSTRIAL FURNACE

TECHNICAL FIELD

This invention relates to a method for the heat treatment of heat treatable material in an industrial furnace, in particular for the annealing of annealable material such as, for example, aluminum strip wound into a coil, by means of blowing of the annealable material with hot gas jets issuing from nozzles. Furthermore, the invention relates to an industrial furnace for the performance of the method.

BACKGROUND OF THE INVENTION

It is known to subject metals, in particular light metallic bodies such as, for example, aluminum strip wound into a coil, to a heat treatment for the purpose of improving the properties thereof, by means of blowing with hot gas jets issuing from nozzles in an annealing furnace. In the case of annealing furnaces usual up to now, the end faces of the stationary coil supported on charging machines are blown with hot gas jets from nozzles rigidly built into the furnace, which can lead to local overheating at the impingement points of the hot gas jets and to reduced heating of the material in the intermediate regions, and thus on the whole to nonuniform heating of the coil. The variable distribution of temperature and flow velocity inside the cross section of the hot gas stream has, as a necessary consequence, locally nonuniform heat transfer, which manifests itself in a nonuniform temperature distribution in the heat treatable material. In order to avoid partial overtemperature in the regions with the greatest heat transfer, the heat flux and thus the heating rate must not be too great. For this reason, the overtemperature as a function of the mean flow velocity of the hot gas must not exceed a critical value. What is more, in the case of annealing furnaces usual up to now, the coils are supported and remain supported on the charging machines or supports located inside the furnace during the heat treatment, which charging machines or supports are heated up by the hot gas stream at the same time, in a fashion undesirable per se, and cause slower heating of the regions of the coil lying in the wind shadow or heat shadow. Furthermore, as a consequence of the one-sided weight loading of the horizontally supported coil, deformations of the coil take place, by which means the unrolling of the aluminum strip can also be impaired on account of the unbalanced and out-of-round running, if one considers that a coil can have the weight of, for example, 30 tons and a diameter of, for example, 2.8 m.

OBJECTS AND SUMMARY OF THE INVENTION

It is an object of the invention to create a method and an industrial furnace for the heat treatment of heat treatable material, in particular of aluminum strip wound into a coil, in which method and industrial furnace, with very good and uniform heat transfer from the hot gas stream to the material, a completely uniform temperature distribution in the heat treatable material and also the rapid heating thereof is insured, without any need to fear locally partial overtemperatures in the heat treatable material.

In the method in accordance with the invention or, respectively, in the industrial furnace in accordance with the invention, the annealable material such as, for example, the coil and the hot gas jets issuing from nozzles are moved relative to one another. In the case of blowing of both end faces of a coil with hot gas jets, for example, this occurs by means of the fact that the coil and/or the hot gas nozzles are rotated about the coil axis, for example back and forth, or also that the coil swings back and forth like a pendulum. In this fashion, the blowing impingement points of the blowing hot gas jets move over the blown surface of the annealable material in order to equalize the heat transfer and the temperature distribution in the annealable material. By means of the relative motion, the hot gas jets dwell for only brief times at the blown places of the coil end faces, and they cover all places uniformly. This rules out local overheating and has the consequence of uniform and rapid heating of the coil blown with hot gas. In the case of specified hot gas flow, the heat flux to be transferred can be made larger by means of increasing the overtemperature, and the heating time of the coil can thereby be shortened. By means of the rotation of the coil about its axis during the heat treatment, the coil suffers no undesirable deformation. By means of the fact that, in accordance with a further feature of the invention, the coil during heat treatment is rotatably supported in pillow blocks outside the annealing furnace, so that no pillow blocks or supporting frameworks interfering with the uniform hot gas inflow are required inside the furnace, the further great advantage is achieved that formations of heat shadows on the coil end faces against which flow impinges are avoided, which formations would otherwise be caused by pillow blocks or supporting frameworks of the coil arranged in the furnace, that is, the annealing furnace in accordance with the invention permits a completely uniform heat treatment of the coil without heat shadows.

BRIEF DESCRIPTION OF THE DRAWINGS

The invention and its further features and advantages are explained in more detail on the basis of the exemplary embodiments schematically illustrated in the Figures.

FIG. 1 shows, in vertical section, an industrial furnace in accordance with the invention for the annealing of aluminum strip wound into a coil (coil and blower not sectioned).

FIG. 2 shows, in sectional view along the line II of FIG. 1, a nozzle plate having radial slotted nozzles and rotatable back and forth.

FIG. 5 shows the view of a nozzle plate having parallel slotted nozzles.

FIG. 6 shows the view of a nozzle plate having radial slotted nozzles.

FIG. 7 shows the view of a nozzle plate having spiral slotted nozzles.

FIG. 8 shows the view of a nozzle plate having annular slotted nozzles concentric with one another.

FIG. 14 shows the view of an obliquely arranged nozzle opening (7*v*) of the nozzle foreplate (6*v*) rotatable about the coil axis, with partially covered (drawn in dashed lines) nozzle opening (7), oblique in the mirror-image sense, in the covered stationary nozzle plate.

FIG. 15 shows the view of an oblique triangular nozzle opening (7*v*) of the nozzle foreplate (6*v*) rotatable about the coil axis, with partially covered (drawn in dashed lines) oblique nozzle opening (7), having a lesser inclination, in the covered stationary nozzle plate.

FIG. 16 shows the view of a nozzle opening (7*v*), having the form of an annular segment, of the nozzle foreplate (6*v*) rotatable about the coil axis, with partially covered (drawn in dashed lines) nozzle opening (7), having the form of an annular segment, in the covered stationary nozzle plate.

FIG. 17 shows a vertical section through the pocket-shaped nozzle box of the annealing furnace in accordance with the invention, having adjustable grid of inlet deflecting vanes (3) [drawn in dashed line in extreme reversing position] in the direction of view toward the nozzle plate.

DETAILED DESCRIPTION OF THE DRAWINGS

Figure 3:
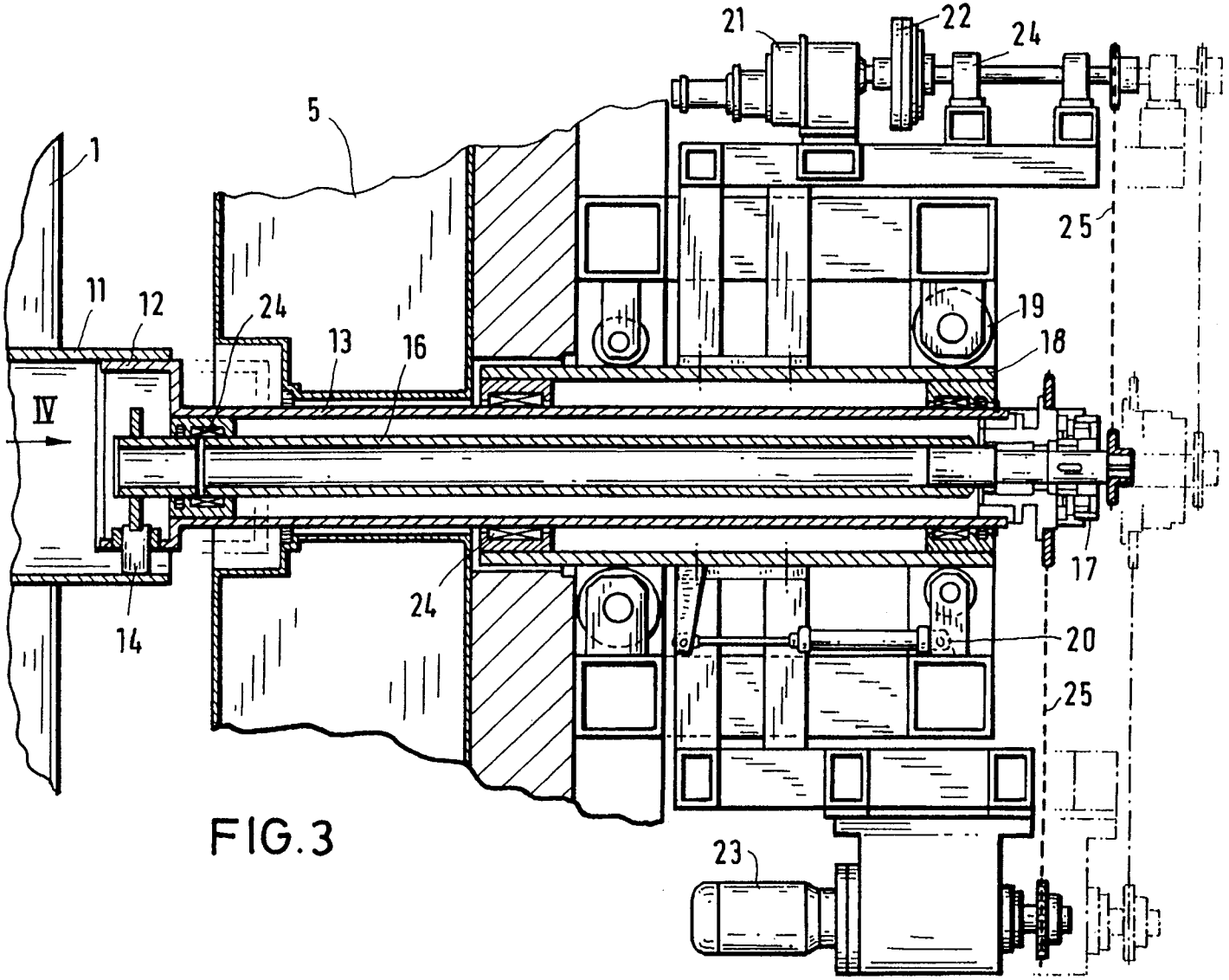
FIG. 3 shows, in longitudinal section, partially in view, a rotation device for the rotation of the coil (drawn in dashed lines in retracted position).

FIG. 1 shows schematically, in vertical section, an industrial furnace in accordance with the invention for the heat treatment of aluminum strip wound into a coil (1) (or of a wound-up foil), having a blower (2) arranged on the furnace cover above the coil for the circulation of a hot gas stream, which is heated to approximately 600° C. by a heating unit (28). From the blower (2), the hot gas flows down on both sides into nozzle boxes (5) and from there through nozzles (7) in the two nozzle plates (6), directly, as hot gas jets (8) of higher velocity, onto the two end faces of the annealable material, which is a cylindrical coil (1) in all the examples. The view II of a nozzle plate (6) having slotted nozzles (7) is illustrated in FIG. 2. In order to achieve high discharge velocities, and thus good heat transfer of the impinging hot gas jets (8), with a reasonable volumetric flow rate, the number of nozzles (7) is limited. In the case of annealing furnaces usual up to now, having stationary coil and rigidly built-in nozzles, this would lead to uneven heating of the coil: to local overheating at the impingement points of the hot gas jets and to reduced heating in the intermediate regions. In accordance with the invention, this disadvantage can be avoided by means of the fact that the coil (1) and/or the nozzle plate (6) with its nozzles (7) is rotated about the coil axis. In the case of simultaneous rotation of nozzle plate and coil, rotation can be effected both in opposite senses and in the same sense. For a rotation of nozzle plate, and coil in the same sense at different rotation speeds, there is likewise a relative motion between the hot gas jets issuing from the nozzle plate and the end face of the coil. Rotations of the stated type have the effect that the hot gas jets dwell for only brief times at the blown places of the coil end faces but all places are uniformly covered in the movement. This rules out local overheating and causes uniform and rapid heating of the blown surface.

The coils are introduced into the furnace by means of a charging machine, not illustrated. After the coil (1) or the coils have been positioned in the furnace space, both supporting mandrel shafts (13) are axially advanced from outside into the coil shell (11) or coil shells. Outside the furnace, the supporting mandrel shafts (13) are supported in well-insulated fashion, so that no supporting frameworks interfering with the uniform hot gas inflow are necessary inside the furnace, which supporting frameworks would lead to formation of heat shadows on the surface of the heat treatable material against which flow impinges.

Figure 4:
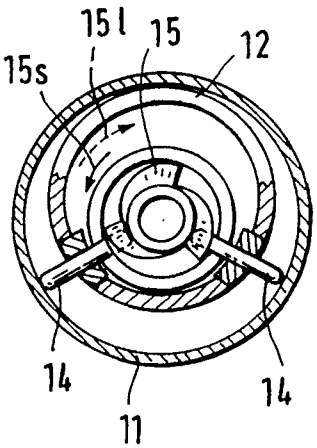
FIG. 4 shows a partial view of the clamping device in the direction of the arrow IV of FIG. 3.
Figure 9:
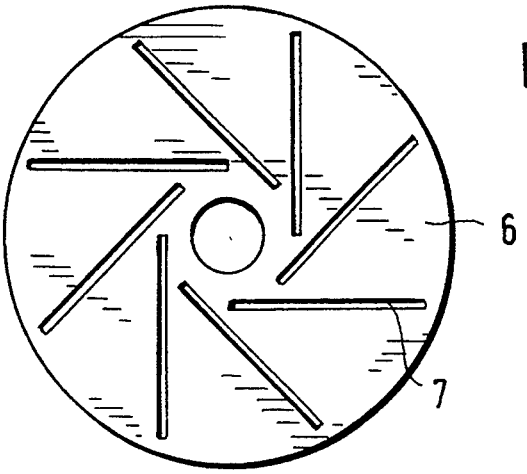
FIG. 9 shows the view of a nozzle plate having obliquely arranged slotted nozzles.
Figure 10:
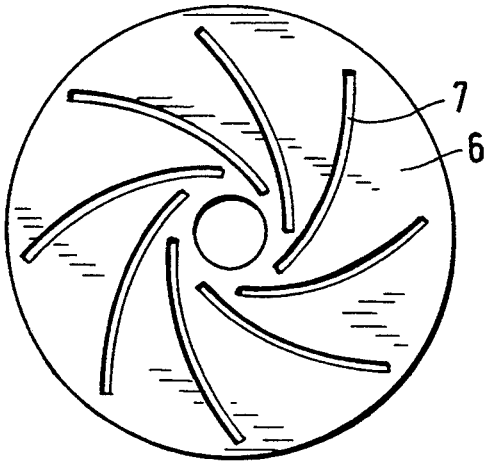
FIG. 10 shows the view of a nozzle plate having backward curved slotted nozzles.
Figure 11:
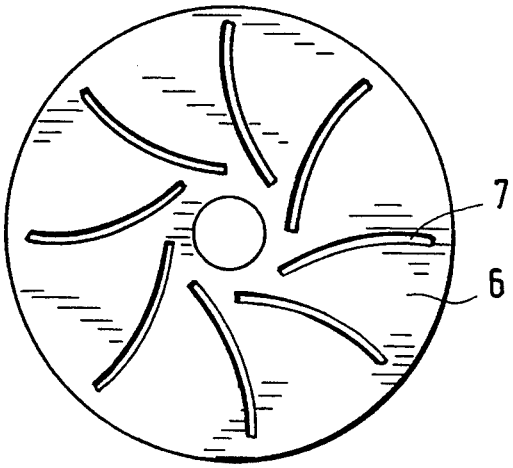
FIG. 11 shows the view of a nozzle plate having forward curved slotted nozzles.

The drive of the supporting mandrel shaft (13) for the rotational or oscillating motion of the coil (1) and the fixing of the supporting mandrel shaft in the coil shell (11) are shown in detail in FIGS. 3 and 4. The coil (1) is lowered by means of the charging machine (not illustrated) until the ends of the coil shells (11) each rest on the advanced supporting mandrel (12) at the top. Afterward, the empty charging machine can be retracted from the furnace again. The placed coil (1) is fixed on the inside wall of the coil shell (11) with two clamping prongs (14) advanced obliquely downward. The supporting mandrel (12) illustrated in FIG. 4 is a circular cylinder whose eccentricity relative to the supporting mandrel shaft (13) exactly corresponds to the difference in radius between the inside radius of the coil shell and the outside radius of the supporting mandrel. The two clamping prongs (14) are then pressed against the interior wall of the coil shell by means of one or a plurality of spiral-shaped or rotary-cam-like cam plates (15), referred to as "clamping plates" in what follows, upon the rotation of the clamping shaft (16) in the rotation direction (15*s*) (compare FIG. 4). The cam drive is self-limiting, so that pressing back of the prongs (14) under load is not possible. The clamping prongs (14) can be released by means of the fact that the clamping shaft (16) with the clamping plates (15) is rotated in the contrary direction (151) (dashed arrow). The clamping drive (21) of the clamping shaft (16) in FIG. 3 is effected, for example, with a compressed-air gear motor via a chain drive (25). The transmission of force can be interrupted with an electromagnetic or pneumatic clutch (22) as soon as the clamping prongs (14) are advanced and clamped against the interior wall of the coil shells.

A variant (not illustrated) for clamping with the clamping prongs (14) can also be implemented via knee levers, which are actuated by means of axial shifting of a rod arranged centrically relative to the coil.

The actuation of the clamping prongs (14) here always takes place-regardless of the type of actuation—with the clamping prongs rotated downward, so that a load-free shifting of the clamping prongs is possible.

The rotation drive (23) of the supporting mandrel shaft (13) is effected with an electric gear motor via a chain drive (25). The supporting mandrel shaft (13) is supported with the bearings (24), for example flexible roller bearings, in a shift housing (18) axially shiftably supported in the rotation device, to which shift housing the mounting frame for the rotation drive (23) and the clamping drive (21) are also attached. For the advancing and retracting of the supporting mandrel (12), the shift housing (18) can be moved axially on guiding rolls (19) by means of the linear advancing and retracting drive (20), for example a pneumatic cylinder (retracted position indicated by dashed lines). If a pneumatic cylinder is employed as linear drive, said cylinder remains unpressurized during furnace operation in order to insure unconstrained thermal expansion of the rotation device.

After clamping, for safety reasons, in addition to clamping with the clamping prongs (14) on the interior wall of the coil shell, the supporting mandrel shaft (13) and the clamping shaft (16) are rigidly coupled to one another at the shaft end outside the furnace with a locking coupling (17), which can be actuated by electromagnetic, pneumatic, pneumatic-mechanical or hydraulic means.

In the case of the clamping device shown in FIGS. 3 and 4, to be sure, the eccentricity of the cylindrical supporting mandrel (12) must be adapted to the inside diameter of the coil shell (11). By means of appropriate design, however, for example by means of adjustable eccentricity, the clamping device in accordance with the invention can also be employed for the clamping of shells having various inside diameters.

FIGS. 5 to 11 show examples of nozzle plates (6) coaxially mounted in the nozzle boxes (5) opposite the end face of the coil (1) and having variously designed forms of slotted nozzles (7): parallel slots (FIG. 5), radial slots (FIG. 6), spiral slots (FIG. 7) and annular slots (FIG. 8). Here the spiral and annular slots are to be stabilized with radial webs (not illustrated). The obliquely running nozzle slots (7) of FIG. 9 begin at the center of the nozzle plate (6) at a small angle to the circumferential direction (smallest possible angle: tangential at 0°) and extend linearly outward at an increasing angle to the circumferential direction. The nozzle slots (7) of FIG. 10 extend outward in backward curved fashion, it also being possible for the backward curvature to be so great that the angle to the circumferential direction remains constant. The nozzle slots (7) of FIG. 11 extend outward in forward curved fashion. By means of these design forms, there is achieved a still more favorable flow of the hot gas jets (8) from the nozzle plate (6), and thus a still more uniform distribution of the hot gas over the coil end faces against which flow impinges.

Figure 12:
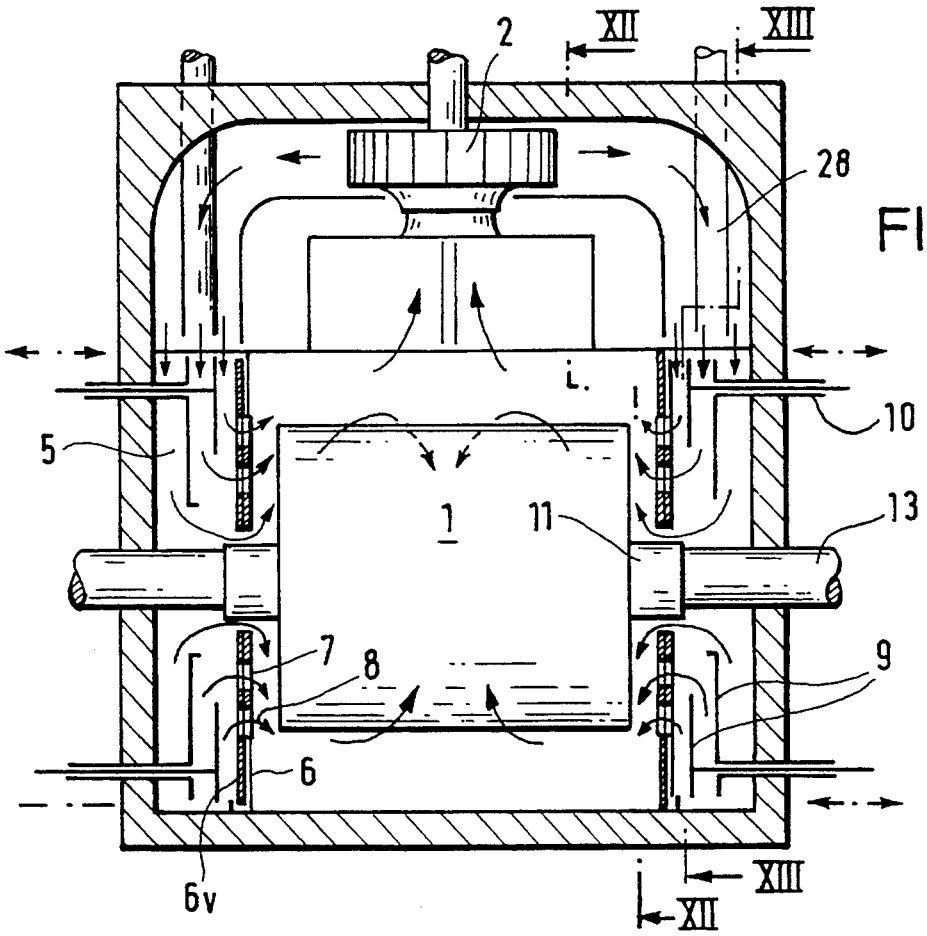
FIG. 12 shows, in vertical section, an annealing furnace having a pair of nozzle plates, one arranged opposite each end face of the coil, having hot gas distribution plates connected upstream thereof.
Figure 13:
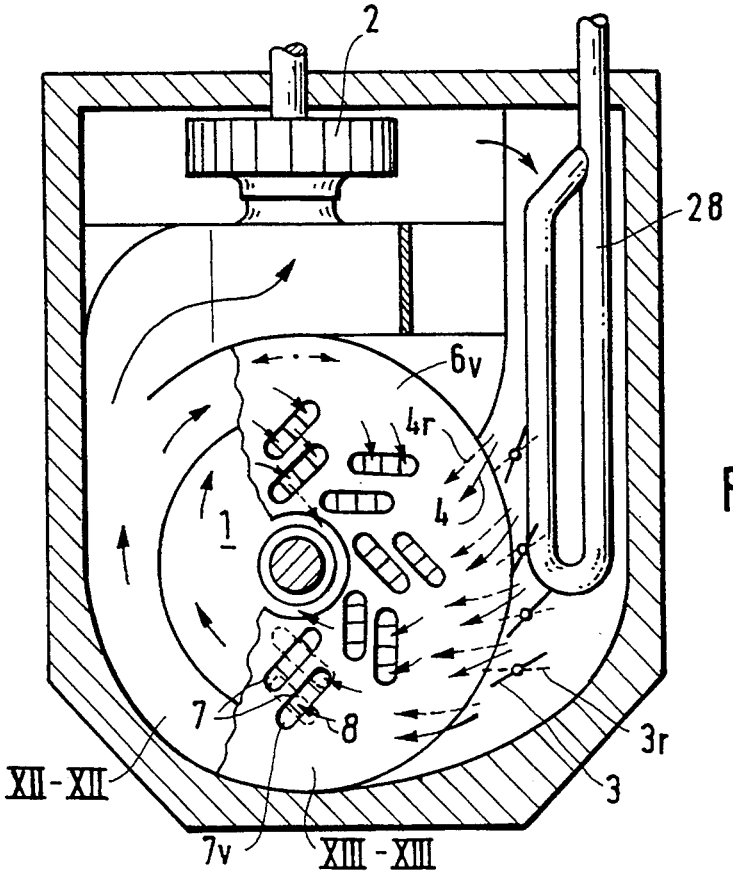
FIG. 13 shows, at left, a section along the line XII—XII of FIG. 12 and, at right, a section along the line XIII—XIII of FIG. 12, having tangential hot gas inflow into the nozzle boxes.

In FIGS. 12 and 13, an exemplary embodiment having double nozzle plates is schematically illustrated, which embodiment permits a desired control of the individual nozzle jets (8). In each of the examples illustrated here, the nozzle plate (6) on the coil side is rigidly built in. Immediately in front thereof, on the side of each nozzle plate (6) away from the coil (1), there is a coaxially rotatable second nozzle plate, referred to as "nozzle foreplate" (6*v*) in what follows. In the case of a nozzle plate pair with fixed and rotatable plate, the plate on the coil side can also be rotatable and the fixed plate can be on the side away from the coil (not illustrated in the examples shown).

In FIG. 13, in the partial section region XIII—XIII at right, a view of the coaxially rotatable nozzle foreplate (6*v*) having oblique, short slotted nozzles (7*v*) can be seen. The covered fixed nozzle plate (6) has similar slotted nozzles (7) arranged in mirror-image fashion, as is indicated by dashed lines in the lower part of the nozzle plate. The slotted nozzles of the fixed nozzle plate (6) and of the rotatable nozzle foreplate (6*v*) thus intersect, so that portions of the slotted nozzle openings are covered and only portions of the slotted nozzles (7) remain open for the nozzle flow (8). These effective nozzle openings (7) move as the nozzle foreplate (6*v*) is moved, so that the nozzle flow (8) shifts in the radial and circumferential direction and in this fashion the end wall of the coil (1) is uniformly and overlappingly swept by the blowing jet.

For elucidation, a partial view of a single mirror-image pair of slotted nozzles is illustrated in FIG. 14, said pair of nozzles having the oblique, short slotted nozzle (7*v*) in the nozzle foreplate (6*v*), which leaves, of the nozzle plate (6) behind said nozzle foreplate, only the effective nozzle opening (7) free for the nozzle flow (8). As a variant, FIG. 15 shows a slotted nozzle pair having unequal slot inclination, the triangular slot (7*v*) in the nozzle: foreplate (6*v*) yielding, in its rotation, variously large effective nozzle openings (7) having radial movement. In the case of the slotted nozzle pair illustrated in FIG. 16, having nozzle slots (7*v*, 7) in the form of annular segments, upon the coaxial rotation of the nozzle foreplate (6*v*) the effective nozzle opening (7) can be made larger or smaller, depending on the requirement. Corresponding shifts of the effective nozzle openings are also made possible by a nozzle plate pair having parallel slotted nozzles in accordance with FIG. 5 or having mirror-image spiral slotted nozzles in accordance with FIG. 7. In principle, with such nozzle plate pairs in accordance with the invention, having corresponding nozzle combinations, in particular slotted nozzle combinations, a multiplicity of desired motions and position changes of the effective nozzle openings (7) can be effected, depending on the requirement.

The back-and-forth rotation of the nozzle plate (6) or nozzle foreplate (6*v*) can take place, for example, via an adjusting rod (not illustrated), which is coupled in the region of the outside plate diameter and is led outward out of the furnace in the circumferential direction. The rotational motion of the nozzle foreplate or of an individual nozzle plate can be introduced there via the adjusting rod having a linear drive. The travel of the linear drive is to be selected here in correspondence with the pitch of the nozzle configuration.

The distribution plates (9) of FIG. 12, adjustable in the axial direction, serve to effect a desired radial distribution of the hot gas inflow to the nozzle foreplate (6*v*). The distribution plates (9) arranged in the nozzle box (5) exhibit central circular openings concentric with the coil axis, the diameters of which openings in the distribution plates become larger toward the nozzle foreplate (6*v*). Here the opening diameter of the distribution plate immediately in front of the nozzle foreplate roughly corresponds (with a tendency toward a somewhat larger diameter) to the largest diameter of the coil (1). The opening diameter of the subsequent distribution plates are graded in correspondence to the desired impingement point of the hot gas. Between every two plates there is a radial annular space, which accommodates a radially inward "sinking flow" or, if a swirl is present, a radially inward "swirling sinking flow." The frictional resistances for the flow are greater or smaller, depending on the spacing between two plates. A close plate spacing results in a higher frictional resistance than a wider plate spacing. Because the volumetric flow rates, in the case of parallel arrangement of resistances, behave in a manner roughly inversely proportional to the square root of the resistance ratio, relatively less hot gas flows between the narrow flow channels having high resistance than between the broader flow channels having lower resistance. A desired distribution of the volumetric flow rates in the radial annular spaces thus results, and after deflection of the flow into the axial direction, the desired radial distribution of the hot gas inflow to the nozzle foreplate (6*v*) also results, given the adjustment of a corresponding distribution of the spacings between the distribution plates (9) or, respectively, the nozzle foreplate (6*v*). The adjustment of the distribution plates (9) can take place from outside via adjusting rods (10). For the better deflection of the radial flow between the distribution plates (9) into an axial flow directed to the nozzle foreplate (6*v*), the central circular openings of the distribution plates (9) can also be made in nozzle fashion.

In FIG. 13, the hot gas inflow channel to the nozzle box (5) is arranged tangentially, so that a swirling flow arises in the nozzle box with a velocity component in the circumferential direction. Ahead of the nozzle box there are deflecting vanes (3), which can also be made adjustable. In the deflecting vane position (3), the hot gas inflow (4) to the nozzle box (5) takes place with a larger swirl component than in the deflecting vane position (3*r*) rotated more into the radial direction (drawn in dashed lines), as the nozzle box inflow (4*r*) effected hereby indicates (drawn in dashed lines).

Figure 18:
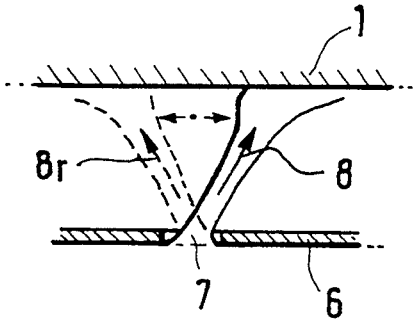
FIG. 18 shows a partial section along the line XVIII— XVIII of FIG. 17 through a nozzle (7) with nozzle jet (8) onto the coil end face (1) and with reversing nozzle jet (8*r*).

Still more pronounced changes in the swirl components of the hot gas inflow result in the case of a pocket-shaped nozzle box having upstream adjustable grid of deflecting vanes in accordance with FIG. 17. In this embodiment, a continuous variation can be effected from deflecting vane position (3) with a swirling flow (4) in the counterclockwise sense to a deflecting vane position (3*r*) (dashed) with a swirling flow (4*r*) in the clockwise sense. As the partial section XVIII—XVIII through a nozzle plate (6) in FIG. 18 shows, upon a change in the swirl, the nozzle flow (8) issuing from the perforated nozzles (7) swings in the circumferential direction to (8*r*) and thus sweeps the end face of the coil (1) against which flow impinges. In this way, local overheating of the coil end face is avoided even at higher blowing velocities with locally good heat transfer on account of the continuously changing impingement point. Because the flow component in the circumferential direction in this embodiment is determined by means of the swirl from the grid of deflecting vanes, an additional flow guidance in the circumferential direction to the nozzles of the nozzle plate (6) should be omitted. Aperture-like nozzle openings, which can also exhibit the cross-sectional and slotted forms described above, also in nozzle plate pairs, prove adequate in this case, so that specially formed nozzle shapes are not required.

The embodiment illustrated in FIG. 17 is adequate without hot gas distribution plates. For this purpose, the heating units (28) are inserted far into the nozzle box (5).

In principle, combinations of the described coil blowing method with moving blowing impingement points of the hot gas jets are also possible, for example: coaxially rotatable nozzle foreplate (6*v*) with radially moved effective nozzle opening combined with coil rotation or swirl in the nozzle box (5) for the moving of the blowing impingement point in the circumferential direction. But the combination of coil rotation and hot gas swirl can also be desirable if an appropriate adaptation is carried out. Thus, in the case of a swirl in the opposite sense to the coil rotation, the circumferential component of the relative flow against the coil is increased; that is, the relative flow against the coil becomes flatter. In the case of a swirl in the same sense as the coil rotation, on the other hand, the circumferential component of the relative flow against the coil becomes smaller, so that the relative flow against the coil flows more steeply against the coil. For the special case where the local hot gas swirl component has the same magnitude and sense as the local circumferential velocity of the coil, the circumferential component of the relative incident flow is zero; that is, the relative incident flow impinges on the coil end face at a right angle, the blowing impingement point, however, changing continuously.

Along with the possibilities indicated of directly effecting the rotational motions of coil (1) and/or nozzle plate (6) or, respectively, nozzle foreplate (6*v*) with the corresponding drives, coil and/or nozzle plate can also be integrated into a pendulum oscillatory system having a low characteristic frequency, which system is excited into pendulum oscillations at the characteristic frequency. For this purpose, the coil and/or the nozzle plate can be connected to appropriately designed rotational spring systems or pendulum systems.

Figure 19:
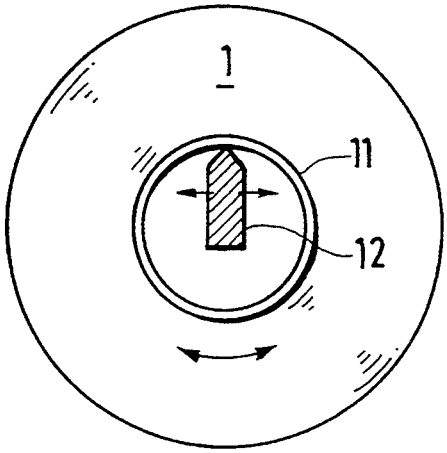
FIG. 19 shows an end view of the coil (1), which is oscillatingly supported with its two coil shells (11) on a supporting mandrel.
Figure 20:
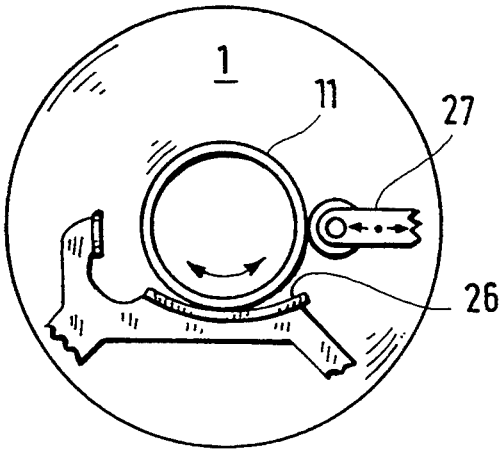
FIG. 20 shows an end view of the coil (1), which is supported oscillatingly, in back-and-forth rolling fashion, with its two coil shells (11) on a concave support plate.

Possibilities for oscillatory rotational motions or pendulum oscillations of, for example, the coil (1) are shown in FIGS. 19 and 20. In FIG. 19, the upper interior wall of the coil shell (11) is placed in pendulum fashion on supporting mandrels (12) at either end. If the two supporting mandrels are moved synchronously, in oscillatory fashion horizontally transversely to the coil axis (double-headed arrow drawn with dot-dash lines), a pendulum oscillation of the coil (1) is excited and the "coil pendulum" oscillates at its characteristic frequency. In this embodiment, again, the impingement points of the hot gas blowing jets move continuously over the oscillating coil end face.

Similar situations arise in the case of a support of the coil shell (11) on concave support plates (26) in accordance with FIG. 20. On such support plates, whose radius of curvature is sufficiently larger than the outside radius of the coil shell, back-and-forth oscillatory rolling motions of the coil (1) can likewise be stimulated. The deflection required for this purpose can be effected, for example, by shift rams (27) engaging at the shell ends at the height of the coil axis and transversely thereto, which shift rams advance horizontally and move along with and in correspondence with the coil motion.

What is claimed is:

1. A method for the heat treatment of a coil (1) of annealable material in an industrial furnace, comprising the steps of:

providing hot gas circulating apparatus in said furnace including at least two nozzle plates each with a plurality of hot gas jets (8), said nozzle plates being positioned to discharge hot gas against the end faces of said coil (1) when the latter is placed in said furnace, supporting said coil of annealable material in said furnace between said nozzle plates, discharging hot gas from said hot gas jets (8) against said end faces of said coil and rotating said nozzle plates relative to said end faces of said coil during said discharge of hot gas to change the points of hot gas impingement on said end faces thereby effecting relatively even heating of said end faces.

2. The method of claim 1 wherein a flow direction component deviating from the perpendicular to the blown face of the coil (1) is imposed on said hot gas jets (8).

3. The method of claim 2 wherein said flow direction component is a swirl.

4. An industrial furnace having top, bottom and side walls defining a heating chamber for heat treating a coil of annealable material comprising:

a hot gas circulating apparatus in said chamber including a blower mounted at said top wall and first and second plenums extending from said blower to opposite side walls of said furnace, said plenums presenting confronting inner walls positioned to be alongside the end faces of said coil being heat treated in said furnaces and a rotatable nozzle plate in and constituting part of each of said inner walls of said plenums, said rotatable nozzle plates being rotatable about a horizontal axis relative to said end faces of said coil and each containing a plurality of hot gas openings defining hot gas jet nozzles directing hot gas jets against the end faces of said coil being heat treated in said furnace.

5. The industrial furnace of claim 4 and further comprising adjustable hot gas distribution plates (9) having coaxial central circular openings, said distribution plates (9) being positioned in said plenums in up stream relation to said nozzle plates.

6. The industrial furnace of claim 4 and further comprising stationary nozzle plates in confronting relation to said rotatable nozzle plates, said stationary nozzle plates having a plurality of hot gas openings defining hot gas jet nozzles which are in at least partially overlapping relation to said hot gas jet nozzles in said rotatable nozzle plates.

7. The industrial furnace of claim 6 wherein said hot gas openings defining said hot gas jet nozzles are slots.

8. The industrial furnace of claim 7 wherein said slots are curved.

* * * * *

UNITED STATES PATENT AND TRADEMARK OFFICE

CERTIFICATE OF CORRECTION

PATENT NO. : 5,449,422

DATED : September 12, 1995

INVENTOR(S) : Rudolf Pflanz

It is certified that error appears in the above-indentified patent and that said Letters Patent is hereby corrected as shown below:

On the title page: Item [73]

"Klöckner-Humboldt-Deutz AG, Cologne,

Germany" and substitute --- Gautschi

Electro-Fours SA, Tägerwilen, Switzerland ---;

Signed and Sealed this

Sixteenth Day of April, 1996

Bruce Lehman

*Attest:*

BRUCE LEHMAN

*Attesting Officer*

*Commissioner of Patents and Trademarks*